US006399931B1

(12) United States Patent
Kang et al.

(10) Patent No.: US 6,399,931 B1
(45) Date of Patent: Jun. 4, 2002

(54) MICROWAVE OVEN WITH DOOR SAFETY SWITCH DEVICE

(75) Inventors: Kwang-seok Kang; Seong-deog Jang, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/778,732

(22) Filed: Feb. 8, 2001

(30) Foreign Application Priority Data

Aug. 19, 2000 (KR) ..... 00-48178

(51) Int. Cl.[7] ..... H05B 6/68

(52) U.S. Cl. ..... 219/723; 219/702; 219/722; 126/197

(58) Field of Search ..... 219/722, 723, 219/724, 702, 716; 126/197; 200/50.12, 50.13

(56) References Cited

U.S. PATENT DOCUMENTS 4,054,769 A 10/1977 Anderson et al. ..... 219/10.55
4,101,750 A * 7/1978 Doner ..... 219/722
4,539,453 A * 9/1985 Miyazaki et al. ..... 219/723
4,672,160 A * 6/1987 Katoh ..... 219/722
5,512,735 A * 4/1996 Hashimoto ..... 219/723

FOREIGN PATENT DOCUMENTS

JP 59-200133 * 11/1984 ..... 219/724

* cited by examiner

*Primary Examiner*—Philip H. Leung
(74) *Attorney, Agent, or Firm*—Robert E. Bushnell, Esq.

(57) ABSTRACT

A microwave oven includes a main casing with a cooking chamber, a door for opening and closing the cooking chamber, and a magnetron in the main casing, for heating food within the cooking chamber. The microwave oven further includes a power supply part, a first door switch closed while the door is closed to supply electric power from the power supply part into the magnetron, a monitor switch connected in series to the first door switch, being operated in reverse relative to the opening and closing of the first door switch, and a control part determining that the first door switch is in trouble where the first door switch and the monitor switch are not operated in reverse to each other, and preventing the electric power from being supplied into the magnetron when the door is opened while the first door switch and the monitor switch are both closed. With this configuration, the number of necessary switches are decreased and the circuits' structure is simplified, and thereby, the cost of production can be lowered and the stability of circuits can be improved.

14 Claims, 5 Drawing Sheets

MICROWAVE OVEN WITH DOOR SAFETY SWITCH DEVICE

CLAIM OF PRIORITY

This application makes reference to, incorporates the same herein and claims all benefits accruing under 35 U.S.C. §119 from an application entitled MICROWAVE OVEN earlier filed in the Korean Industrial Property Office on the 19th day of August 2000, and there duly assigned Ser. No. 48178/2000.

BACKGROUND OF THE INVENTION

1. Field of the Invention

This invention relates in general to microwave ovens, and more particularly, to a microwave oven having a safety device of the door thereon, with a simplified circuit structure.

2. Description of the Related Art

Conventionally, a microwave oven includes a main casing having a cooking chamber and an electronic component chamber, a door for opening and closing an opened front part of the cooking chamber, and a control panel provided in the main casing, for driving a number of components in the microwave oven. In the component chamber are provided a high-voltage transformer generating high-voltage based on an electric power supplied from a power supply part, and a magnetron generating electromagnetic waves based on the high-voltage generated by the high-voltage transformer.

The microwave oven is equipped with a safety device to prevent the electromagnetic waves from being supplied into the cooking chamber while the door is being opened. The safety device includes a latch member mounted in the door so as to be engaged with a pair of hook holes provided in the front part of the cooking chamber, and a group of switches, so called a safety switch part, which are connected on or off depending upon the opening and closing of the door. The latch member includes a pair of hooks fitted into the hook holes; and the safety switch part includes a first door switch, a second door switch and a monitor switch capable of controlling the on-and-off operation thereof depending upon the operation of the hooks of the latch member.

Hereinafter, the conventional safety device for the door will be described in more detail with reference to a detailed circuit diagram shown in FIG. 5.

The conventional microwave oven has a power supply part 130, a high-voltage transformer 131 generating high-voltages based on the electric power supplied from the power supply part 130, and a magnetron 133 generating electromagnetic waves generated based on the high-voltages from the high-voltage transformer 131. In the microwave oven is provided a safety switch part cooperating with opening and closing of the door (not shown) on the microwave oven. The safety switch part includes a first door switch 145 operated so as to be switched on by pressure by the hook (not shown) of a latch member (not shown), and a second door switch 147 operated to be switched on and off according to a control signal inputted through a control panel (not shown).

Referring to the illustrated circuit diagram, a first current line L2 and a second current line L3 are provided to both ends of a primary coil of the high-voltage transformer 131. A common current line L1 is installed between the first and second current lines L2 and L3, forming a closed loop by being combined with one another.

On the common current line L1 are provided power supply part 130, and a fuse 135 for cutting off overcurrent.

Between the common current line L1 and the first current line L2 are provided a lamp 137 connected in parallel to the common current line L1, for illuminating the inside of the cooking chamber, and a relay switch 141 connected in series to the lamp 137, for controlling the on-and-off operation of the lamp 137. Between the common current line L1 and the first current line L2 are also provided a fan motor 139 connected in parallel to the common current line L1, for activating a fan (not shown), and a relay switch 143 connected in series to the fan motor 139, for controlling the operation of the fan motor 139. A pair of monitor switches 149 are respectively provided between the common current line L1 and the first current line L2, and the common current line L1 and the second current line L3. The monitor switches are closed when the door is being opened whereas they are opened when the door is closed.

With this configuration, the first door switch 145 and the second door switch 147 are switched-off when the door is opened, thereby cutting off the electric power supplied into the magnetron 133. Consequently, the electromagnetic waves from the magnetron 133 cannot be applied into the cooking chamber while the door is being opened.

In the conventional microwave wave oven equipped with a safety device detecting opening and closing of the door, in order to provide more effective safety devices, it would be necessary to reduce the number of the safety switches and have a simplified configuration of the circuit, thereby saving the cost of production and avoiding the complexity of the circuits' configuration.

SUMMARY OF THE INVENTION

Therefore, the present invention has been made in view of the above need, and it is an object of the present invention to provide a microwave oven with a safety device having a simplified configuration of circuits by decreasing the number of switches.

This and other objects of the present invention may be achieved by a provision of the microwave oven including a main casing with a cooking chamber, a door for opening and closing the cooking chamber, and a magnetron in the main casing, for heating food within the cooking chamber, the microwave oven further includes a power supply part; at least a first door switch closed while the door is closed so as to supply electric power from the power supply part into the magnetron; a monitor switch connected in series to the first door switch, being operated in reverse relative to the opening and closing of the first door switch; and a control part determining that the first door switch is in trouble where the first door switch and the monitor switch are not operated in reverse to each other, and preventing the electric power from being supplied into the magnetron when the door is opened under the state that the first door switch is closed.

Preferably, the microwave oven further includes a fuse being provided between the power supply part and the first door switch, for cutting off overcurrent, and where the control part short-circuits the fuse when the door is opened while the first door switch and the monitor switch are both closed.

The control unit preferably supplies an electric power to a driver a switching element when the first door switch is closed.

More preferably, the microwave oven further includes a second door switch operated in conformity with the opening and closing of the first door switch, and cooperating with the first door switch, allowing the electric power from the power supply part so as to be supplied into the magnetron when the door is closed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
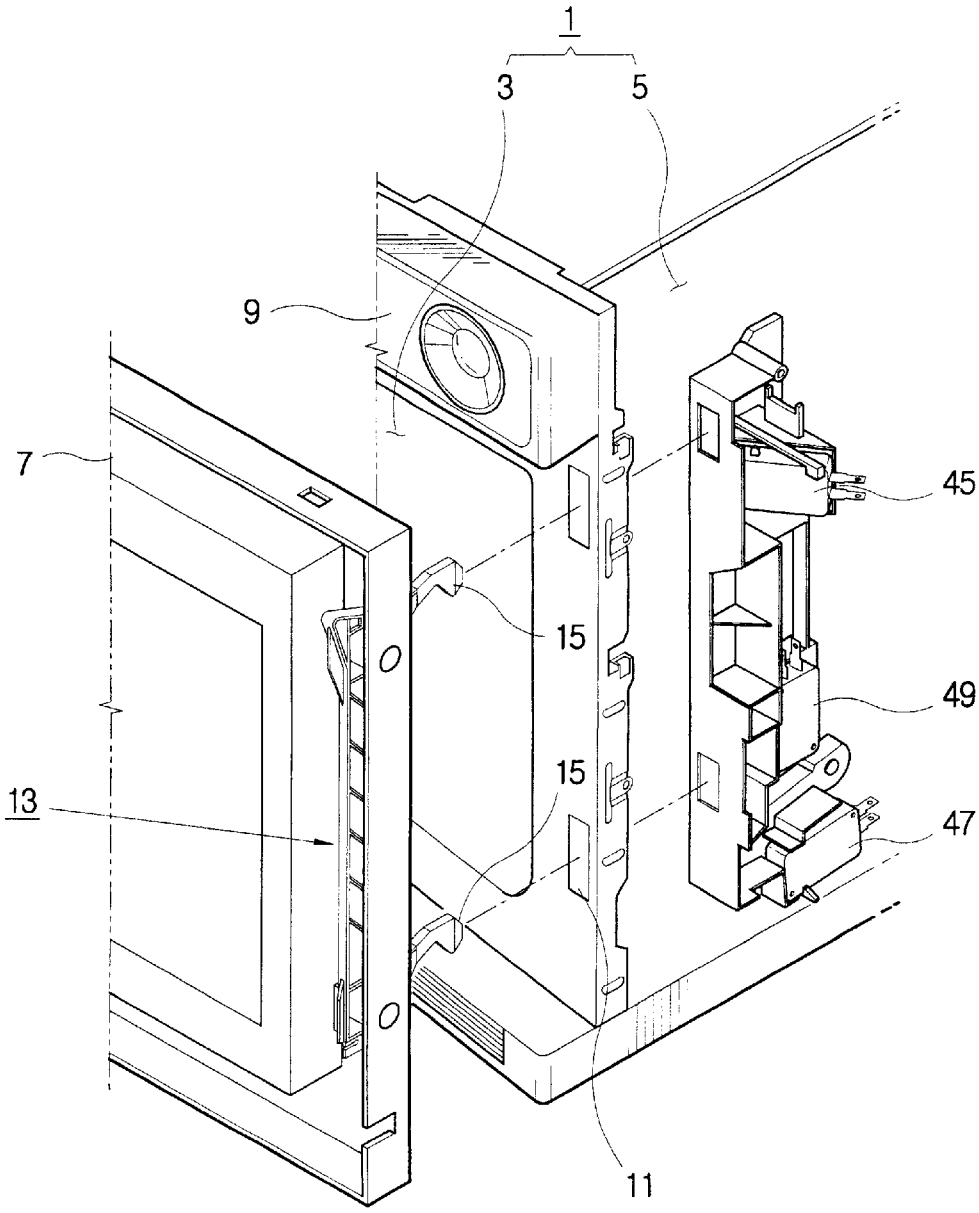
FIG. 1 is a perspective view of a microwave oven according to the present invention.
Figure 2:
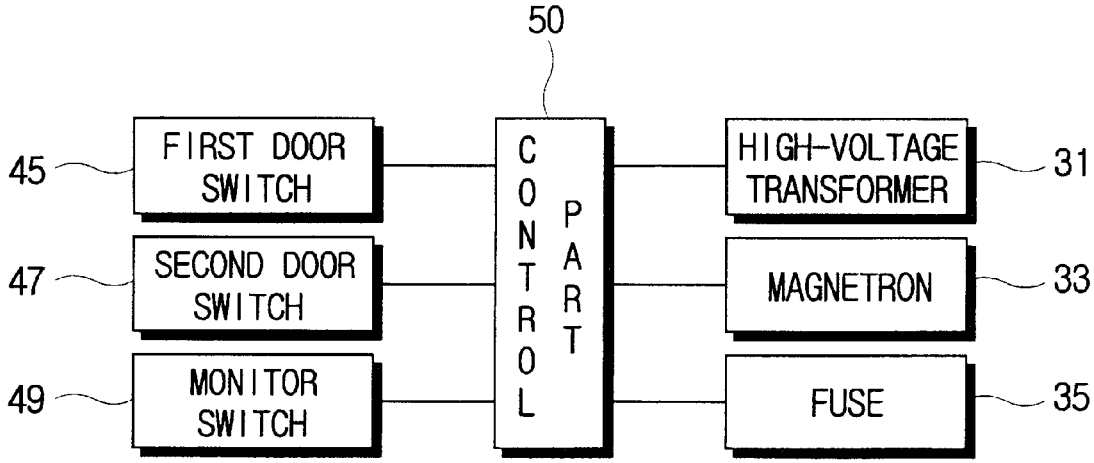
FIG. 2 is a block diagram of a control part according to the present invention.

Referring to FIGS. 1 and 2 related to a microwave oven according to the present invention, the microwave oven includes a main casing 1 partitioned into a cooking chamber 3 into which food to be cooked is put, and a component chamber 5 in which a number of devices and components are mounted, a door 7 opening and closing the front part of the cooking chamber 3 and a control panel 9 provided in the front part of the component chamber, for driving the devices and components.

Inside the component chamber 5 are provided a high-voltage transformer 31 generating high-voltages based on electric power supplied from an electric power supply part 30 (FIG. 3), and a magnetron 33 generating electromagnetic waves based on the high-voltages generated by the high-voltage transformer 31.

The microwave oven is provided with a safety device to prevent the electromagnetic waves from being supplied into the cooking chamber 3 while the door is being opened. As illustrated in FIGS. 1 and 2, the safety device includes a latch member 13 mounted on the door 7 to be fitted into a pair of hook holes 11 provided in the front part of the cooking chamber 3, and a safety switch part cooperating with the latch member 13 according to opening and closing of the door 7.

The latch member 13 has a pair of hooks 15 to be fitted into the pair of hook holes 11, and the safety switch part includes a first door switch 45 which is closed and opened according to the opening and closing movement of the door 7, a second door switch 47 which is opened and closed according to inputted control signals, and a monitor switch 49 which is operated in reverse relative to the first door switch 45.

The microwave oven is also provided with a fuse 35 to prevent overcurrent from flowing into the circuit, and a control part 50 to cut off the electric power supplied into the magnetron 33, based on the operation of the safety switch part. The control part 50 supplies an electric power to a driver 60 driving each door switch as switching elements when the first door switch is closed.

Where the first and second door switches and the monitor switches are all closed, or they are all opened, the control part 50 determines that at least one of the switches is in trouble. When the control part 50 detects a trouble in the safety switch part, the control part enables the fuse 35 to be forcibly cut off if the door 7 is opened.

Hereinafter, the safety device of the present invention will be in more detail described referring to FIGS. 3 and 4.

Figure 3:
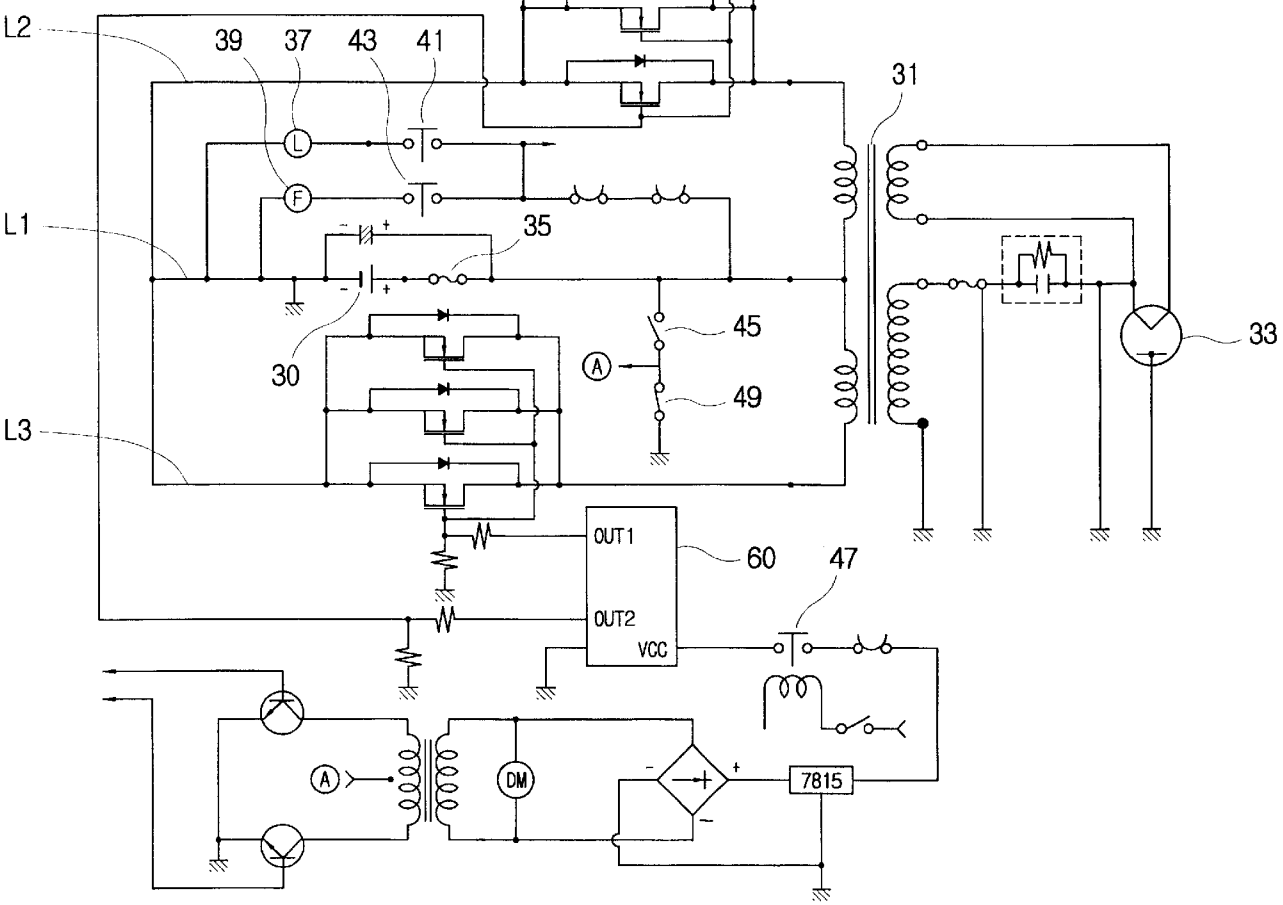
FIG. 3 is a detailed circuit diagram of a door safety device according to the present invention.
Figure 4:
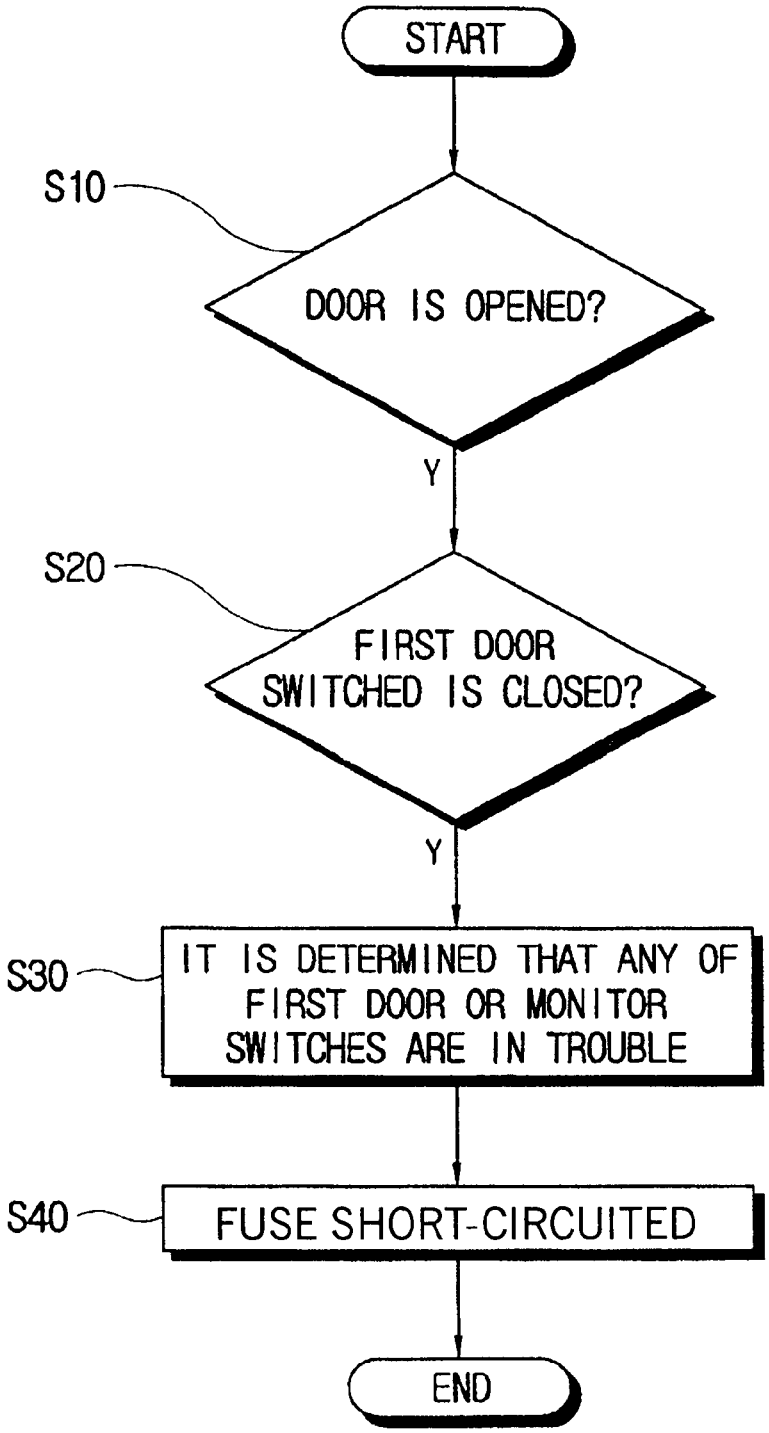
FIG. 4 is a flow diagram of the door safety device according to the present invention.
Figure 5:
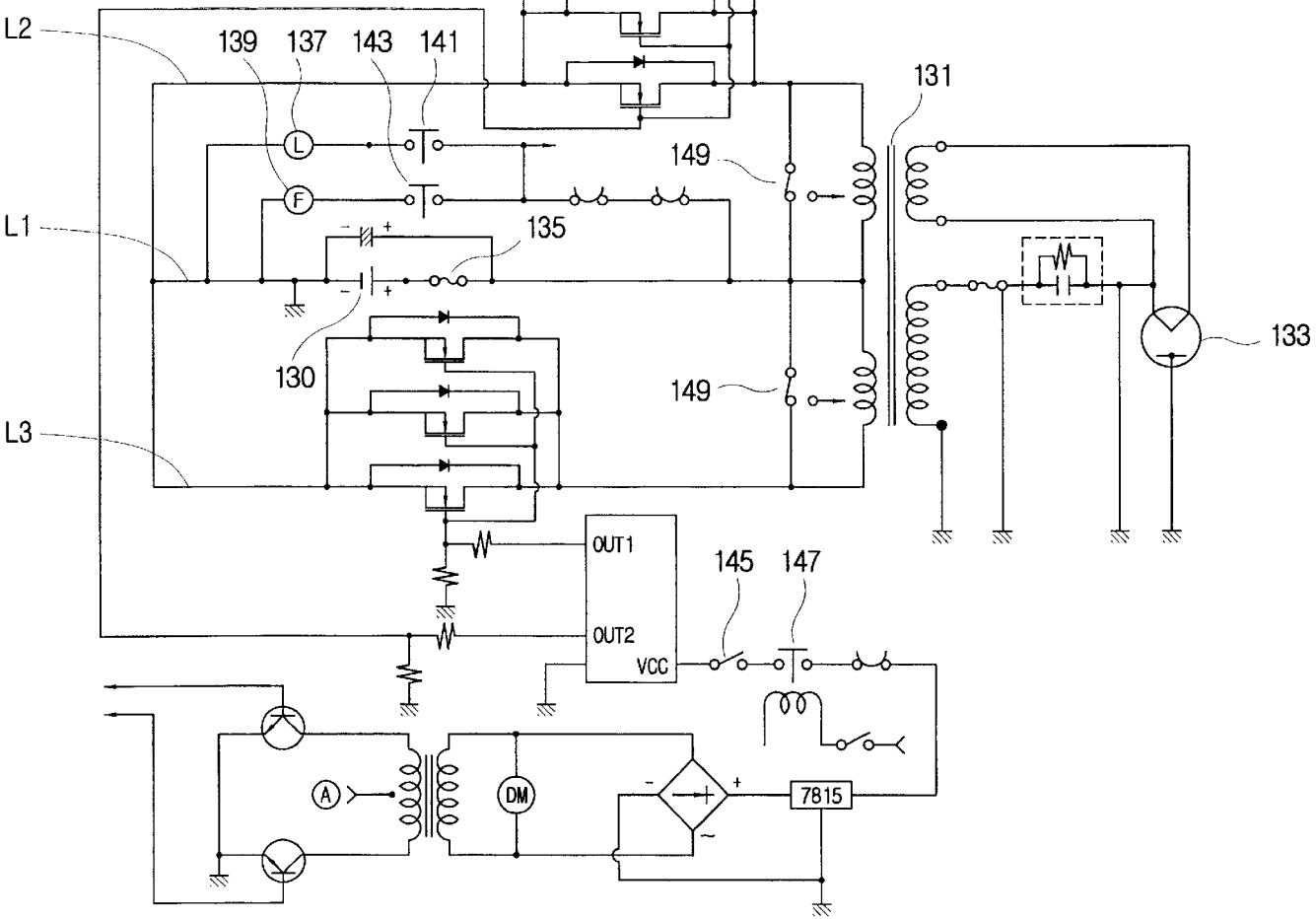
FIG. 5 is a detailed circuit diagram of the conventional door safety device.

FIG. 3 is a detailed circuit diagram of the door safety device according to the present invention, and FIG. 4 is a block diagram of the door safety device according to the present invention.

The microwave oven with the safety device includes the power supply part 30 supplying an electric power to the oven, the high-voltage transformer 31 generating high-voltages based on the electric power supplied from the power supply part 30, a commercial current line connecting the power supply part 30 and the high-voltage transformer 31 and forming a closed loop, and the magnetron 33 generating electromagnetic waves based on the high-voltages generated by the high-voltage transformer 31.

The commercial current line includes a first current line L2 and a second current line L3 connected to a primary coil of the high-voltage transformer 31, and a common current line L1 between the first current line L2 and the second current line L3, forming the closed loop together with the first and second current lines L2 and L3.

On the common current line L1 are provided the fuse 35 to prevent the overcurrent from being supplied into such components as the power supply part 30, the magnetron 33, etc. On a closed loop (hereinafter, "first closed loop") formed by the first current line L2 and the common current line L1, a lamp 37 illuminating the cooking chamber 3 and a fan motor 39 driving a fan (not shown) are connected in parallel. On the first closed loop, a pair of relay switches 41 and 43 are each connected in series to the lamp 37 and the fan motor 39, for controlling the operation of the lamp 37 and the fan motor 39.

On a closed loop (hereinafter, "second closed loop") formed by the second current line L3 and the common current line L1 is provided the first door switch 45 connected in series to the power supply part 30 and closed when the door 7 is closed. On the second closed loop is also provided the monitor switch 49 operated in reverse relative to the operation of the first door switch 45. Further, the second door switch 47 is provided on the commercial current line 7, which is closed according to the external control signals when the door is closed, i.e., when the first door switch 45 is closed. FIG. 3 additionally illustrates a number of devices and components such as a low-voltage transformer, a temperature sensor, a switch for sensing opening and closing of the door, and a field effect transistor(FET), etc.

With this configuration, while the door 7 of the microwave oven is closed, the first door switch 45 is maintained in the state of being closed. The second door switch 47 is in the state of being closed if external closing signals are inputted. At this time, the monitor switch 49 is in the state of being open, thereby allowing the electric power from the power supply part 30 to be supplied into the magnetron 33. The electromagnetic waves generated by the magnetron 33 based on the supplied electric power are supplied into the cooking chamber 3.

However, where the door of the microwave oven is opened, the first door switch 45 is maintained in the state of being opened. Thus, irrespective of whether the second door switch 47 is opened or closed, the electric power to be supplied into the magnetron can be cut off.

As shown in FIG. 4, the control part 5 (refer to FIG. 2) first determines whether the door is closed or opened (S10), and then determines whether the first door and monitor switches 45 and 49 are in the state of being closed when the door 7 is opened (S20). If the first door and monitor switches 45 and 49 are closed while the door 7 is being opened, the control part 50 determines that at least one of the switches 45 and 49 are in trouble (S30). Then, the control part 50 forcibly cuts off the fuse 35 provided between the power supply part 30 and the first door switch 45 (S40). When the fuse 35 is forcedly cut off by the control part 50, the generation of the electromagnetic waves from the magnetron 33 can be prevented while the door 7 is opened, and therefore, the stability of the circuit can be further improved.

As described above, according to the present invention, the microwave oven includes the power supply part; the first door switch closed when the door is closed, supplying the electric power from the power supply part into the magnetron; the monitor switch which is opened and closed in reverse relative to opening and closing of the first door switch, and the control part determining that the first door switch is in trouble where the first door switch and the monitor switch are not operated in reverse to each other, and preventing the electric power from being supplied into the magnetron when the door is opened while the first door switch and the monitor switch are both closed.

In consequence, the number of necessary switches is decreased, and the circuits' structure is simplified. With this configuration, the cost of production can be lowered and the stability of the circuit can be improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven comprising a main casing with a cooking chamber, a door for opening and closing the cooking chamber, and a magnetron in the main casing, for heating food within the cooking chamber, said microwave oven, further comprising:

a power supply part;

at least a first door switch closed while the door is closed so as to supply electric power from the power supply part into the magnetron;

a monitor switch connected in series to the first door switch, being operated in reverse relative to the opening and closing of the first door switch; and a control part determining the first door switch being in trouble where the first door switch and the monitor switch are not operated in reverse to each other, and preventing the electric power from being supplied into the magnetron when the door is opened under the state of the first door switch being closed.

2. The microwave oven according to claim 1, further comprising:

a fuse being provided between the power supply part and the first door switch, for cutting off overcurrent, and wherein the control part short-circuits the fuse when the door is opened while the first door switch and the monitor switch are both closed.

3. The microwave oven according to claim 2, further comprised of the control part supplying an electric power to a driver driving a switching element when the first door switch is closed.

4. The microwave oven according to claim 3, further comprising a second door switch operated in response to the opening and closing of the first door switch, and cooperating with the first door switch, allowing the electric power from the power supply part to be supplied into the magnetron when the door is closed.

5. The microwave oven according to claim 1, further comprised of the control part supplying an electric power to a driver driving a switching element when the first door switch is closed.

6. The microwave oven according to claim 1, further comprising a second door switch operated in response to the opening and closing of the first door switch, and cooperating with the first door switch, allowing the electric power from the power supply part to be supplied into the magnetron when the door is closed.

7. The microwave oven according to claim 6, with the electric power supplied into the magnetron being cut off irrespective of whether the second door switch is opened or closed when the door of the microwave is open and then the first door switch is maintained in the sate of being opened.

8. A method for a microwave oven, comprising the steps of:

supplying electric power from a power supply part of said microwave oven into a magnetron of said microwave oven when a first door switch is closed while a door of said microwave oven is closed;

operating a monitor switch in reverse relative to the opening and closing of said first door switch, said monitor switch connected to said first door; and determining said first door switch being in trouble by a control part where said first door switch and said monitor switch are not operated in reverse to each other, and preventing the electric power from being supplied into said magnetron when said door is opened under the state of said first door switch being closed.

9. The method of claim 8, further comprising the step of short-circuiting a fuse by said control part when said door is opened while said first door switch and said monitor switch are both closed, said fuse being provided between said power supply part and said first door switch, for cutting off overcurrent.

10. The method of claim 9, further comprising the step of supplying electric power to a driver driving a switching element by said control part when said first door switch is closed.

11. The method of claim 10, further comprising the step of operating a second door switch in response to the opening and closing of said first door switch, and cooperating with said first door switch, allowing said electric power from said power supply part to be supplied into said magnetron when said door is closed.

12. A microwave oven, comprising a main casing with a cooking chamber, a door for opening and closing the cooking chamber, and a magnetron in the main casing, for heating food within the cooking chamber, said microwave oven, further comprising:

a power supply part;

a first door switch closed while the door is closed so as to supply electric power from the power supply part into the magnetron;

a monitor switch connected in series to the first door switch, being operated in reverse relative to the opening and closing of the first door switch;

a second door switch operated in response to the opening and closing of the first door switch, and cooperating with the first door switch, allowing the electric power from the power supply part to be supplied into the magnetron when the door is closed;

a control part determining at least one of the switches being in trouble where the first door switch, monitor switch, and second door switch are all closed or all open, and preventing the electric power from being supplied into the magnetron when the door is opened under the state of the first door switch being closed.

13. The microwave oven of claim 12, further comprising:

a fuse being provided between the power supply part and the first door switch, for cutting off overcurrent, and wherein the control part short-circuits the fuse when the door is opened while the first door switch and the monitor switch are both closed.

14. The microwave oven according to claim 13, with the control part supplying an electric power to a driver driving a switching element when the first door switch is closed.

* * * * *